US009731888B2

(12) United States Patent
Euler et al.

(10) Patent No.: US 9,731,888 B2
(45) Date of Patent: Aug. 15, 2017

(54) BLANK FOR CONTAINER

(71) Applicant: Berry Plastics Corporation, Evansville, IN (US)

(72) Inventors: John B Euler, Evansville, IN (US); Jason J Paladino, Newburgh, IN (US); Chris K Leser, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 14/106,212

(22) Filed: Dec. 13, 2013

(65) Prior Publication Data

US 2014/0166734 A1 Jun. 19, 2014

Related U.S. Application Data

(60) Provisional application No. 61/737,406, filed on Dec. 14, 2012.

(51) Int. Cl.

| | |
|---|---|
| ***B65D 81/38*** | (2006.01) |
| ***B65D 5/66*** | (2006.01) |
| ***B65D 5/20*** | (2006.01) |

(52) U.S. Cl.

CPC ..... *B65D 81/3848* (2013.01); *B65D 5/2052* (2013.01); *B65D 5/6661* (2013.01); *B65D 81/3851* (2013.01); *B65D 81/3865* (2013.01); *B65D 2301/20* (2013.01)

(58) Field of Classification Search

USPC ..... 229/141, 103.11, 125.28, 125.31, 147; 220/592.26; 493/903

See application file for complete search history.

(56) References Cited

U.S. PATENT DOCUMENTS

| | | | | |
|---|---|---|---|---|
| 1,396,282 | A | | 11/1921 | Penn |
| 1,435,120 | A | | 11/1922 | Holman |
| 1,920,529 | A | | 8/1933 | Sidebotham |
| 1,969,030 | A | | 8/1934 | Page |
| 2,097,899 | A | | 11/1937 | Smith |
| 2,809,776 | A | * | 10/1957 | Barrington et al. ..... 229/195 |
| 3,221,954 | A | | 12/1965 | Lux |
| 3,227,784 | A | | 1/1966 | Blades |
| 3,252,387 | A | | 5/1966 | Schur |
| 3,290,198 | A | | 12/1966 | Lux |
| 3,312,383 | A | | 4/1967 | Shapiro |
| 3,327,038 | A | | 6/1967 | Fox |
| 3,327,103 | A | | 6/1967 | Bonnet |
| 3,344,222 | A | | 9/1967 | Shapiro |
| 3,381,880 | A | | 5/1968 | Lewallen et al. |

(Continued)

FOREIGN PATENT DOCUMENTS

| | | |
|---|---|---|
| BE | 898053 | 4/1984 |
| CA | 2291607 | 6/2000 |

(Continued)

OTHER PUBLICATIONS

Office action dated Apr. 11, 2014 for U.S. Appl. No. 13/526,417.

(Continued)

*Primary Examiner* — Christopher Demeree

(74) *Attorney, Agent, or Firm* — Barnes & Thornburg LLP

(57) ABSTRACT

A blank made of a polymeric material is provided and used to form at least a portion of a container. The blank is folded to establish a base and a side wall included in the container.

24 Claims, 3 Drawing Sheets

(56) References Cited

U.S. PATENT DOCUMENTS 3,409,204 A 11/1968 Carle
3,431,163 A 3/1969 Gilbert
3,468,467 A 9/1969 Amberg
3,547,012 A 12/1970 Amberg
3,583,624 A 6/1971 Peacock
3,658,615 A 4/1972 Amberg
3,661,282 A 5/1972 Buhayar
3,733,381 A 5/1973 Willette
3,793,283 A 2/1974 Frailey
3,846,349 A 11/1974 Harada
3,907,193 A * 9/1975 Heller ..... B29C 53/063 229/930
3,919,368 A * 11/1975 Seto ..... 264/45.1
RE28,658 E 12/1975 Macdaniel
3,967,991 A 7/1976 Shimano
3,969,173 A 7/1976 Amberg
3,971,696 A 7/1976 Manfredi
3,973,721 A 8/1976 Nakane
3,981,412 A 9/1976 Asmus
4,026,458 A 5/1977 Morris
4,049,122 A 9/1977 Maxwell
4,070,513 A 1/1978 Rhoads
4,106,397 A 8/1978 Amberg
4,171,085 A 10/1979 Doty
4,197,948 A 4/1980 Amberg
4,240,568 A 12/1980 Pool
4,284,226 A 8/1981 Herbst
4,288,026 A 9/1981 Wilhelm
4,298,331 A 11/1981 Mueller
4,299,349 A 11/1981 Gilden
4,300,891 A 11/1981 Bemiss
4,306,849 A 12/1981 Cress
4,310,369 A 1/1982 Miller
4,349,400 A 9/1982 Gilden
4,365,460 A 12/1982 Cress
4,391,666 A 7/1983 Mueller
4,409,045 A 10/1983 Busse
4,490,130 A 12/1984 Konzal
4,550,046 A 10/1985 Miller
4,579,275 A 4/1986 Peelman
4,604,324 A 8/1986 Nahmias
4,621,763 A 11/1986 Brauner
4,706,873 A 11/1987 Schulz
4,720,023 A 1/1988 Jeff
4,856,989 A 8/1989 Siebert
4,878,970 A 11/1989 Schubert
4,918,112 A 4/1990 Roox
4,940,736 A 7/1990 Alteepping
5,078,817 A 1/1992 Takagaki
5,116,881 A 5/1992 Park
5,149,579 A 9/1992 Park
5,158,986 A 10/1992 Cha
5,160,674 A 11/1992 Colton
5,180,751 A 1/1993 Park
5,236,963 A 8/1993 Jacoby
5,256,462 A 10/1993 Callahan
5,286,428 A 2/1994 Hayashi
5,308,568 A 5/1994 Lipp
5,348,795 A * 9/1994 Park ..... C08J 9/14 428/220
5,366,791 A 11/1994 Carr
5,385,260 A 1/1995 Gatcomb
5,443,769 A 8/1995 Karabedian
5,445,315 A 8/1995 Shelby
5,490,631 A 2/1996 Iioka
5,507,640 A 4/1996 Gilmer
5,547,124 A 8/1996 Mueller
5,549,864 A 8/1996 Greene
5,605,936 A 2/1997 DeNicola, Jr.
5,622,308 A 4/1997 Ito
5,628,453 A 5/1997 MacLaughlin
5,629,076 A 5/1997 Fukasawa
5,713,512 A 2/1998 Barrett
5,759,624 A 6/1998 Neale
5,765,710 A 6/1998 Bergerioux
5,766,709 A 6/1998 Geddes
5,769,311 A 6/1998 Morita
5,819,507 A 10/1998 Kaneko
5,840,139 A 11/1998 Geddes
5,866,053 A 2/1999 Park
5,868,309 A 2/1999 Sandstrom
5,895,614 A 4/1999 Rivera
5,925,450 A 7/1999 Karabedian
5,928,741 A 7/1999 Andersen
5,944,225 A 8/1999 Kawolics
5,948,839 A 9/1999 Chatterjee
6,007,437 A 12/1999 Schickert
6,010,062 A 1/2000 Shimono
6,030,476 A 2/2000 Geddes
6,034,144 A 3/2000 Shioya
6,051,174 A 4/2000 Park
6,071,580 A 6/2000 Bland
6,083,611 A 7/2000 Eichbauer
6,103,153 A 8/2000 Park
6,109,518 A 8/2000 Mueller
6,129,653 A 10/2000 Fredricks
6,136,396 A 10/2000 Gilmer
6,139,665 A 10/2000 Schmelzer
6,142,331 A 11/2000 Breining
6,169,122 B1 1/2001 Blizard
6,174,930 B1 1/2001 Agarwal
6,193,098 B1 2/2001 Mochizuki
6,218,023 B1 4/2001 DeNicola
6,231,942 B1 5/2001 Blizard
6,235,380 B1 5/2001 Tupil
6,251,319 B1 6/2001 Tusim
6,257,485 B1 7/2001 Sadlier
6,258,862 B1 7/2001 Matz
6,267,837 B1 7/2001 Mitchell
6,284,810 B1 9/2001 Burnham
6,294,115 B1 9/2001 Blizard
6,306,973 B1 10/2001 Takaoka
6,308,883 B1 10/2001 Schmelzer
6,319,590 B1 11/2001 Geddes
6,328,916 B1 12/2001 Nishikawa
6,376,059 B1 4/2002 Anderson
6,378,733 B1 4/2002 Boonzaier
6,379,802 B2 4/2002 Ito
6,383,425 B1 5/2002 Wu
6,420,024 B1 7/2002 Perez
6,444,073 B1 9/2002 Reeves
6,455,150 B1 9/2002 Sheppard
6,468,451 B1 10/2002 Perez
6,472,473 B1 10/2002 Ansems
RE37,932 E 12/2002 Baldwin
6,512,019 B1 1/2003 Agarwal
6,521,675 B1 2/2003 Wu
6,541,105 B1 4/2003 Park
6,562,447 B2 5/2003 Wu
6,565,934 B1 5/2003 Fredricks
6,586,532 B1 7/2003 Gauthy
6,593,005 B2 7/2003 Tau
6,593,384 B2 7/2003 Anderson
6,613,811 B1 9/2003 Pallaver
6,616,434 B1 9/2003 Burnham
6,646,019 B2 11/2003 Perez
6,649,666 B1 11/2003 Read
6,713,139 B2 3/2004 Usui
6,720,362 B1 4/2004 Park
6,749,913 B2 6/2004 Watanabe
6,779,662 B2 8/2004 Dorsey
6,811,843 B2 11/2004 DeBraal
6,814,253 B2 11/2004 Wong
6,875,826 B1 4/2005 Huovinen
6,883,677 B2 4/2005 Goeking
6,884,377 B1 4/2005 Burnham
6,884,851 B2 4/2005 Gauthy
6,908,651 B2 6/2005 Watanabe
6,926,507 B2 8/2005 Cardona
6,926,512 B2 8/2005 Wu
6,982,107 B1 1/2006 Hennen
7,056,563 B2 6/2006 Halabisky
7,070,852 B1 7/2006 Reiners
7,074,466 B2 7/2006 DeBraal

(56) References Cited

U.S. PATENT DOCUMENTS 7,094,463 B2 8/2006 Haas
7,121,991 B2 10/2006 Mannlein
7,144,532 B2 12/2006 Kim
7,173,069 B2 2/2007 Swennen
7,234,629 B2 * 6/2007 Ho ..... 229/117.08
7,281,650 B1 10/2007 Milan
7,355,089 B2 4/2008 Chang
7,361,720 B2 4/2008 Pierini
7,365,136 B2 4/2008 Huovinen
7,423,071 B2 9/2008 Mogami
7,458,504 B2 12/2008 Robertson
7,504,347 B2 3/2009 Poon
7,510,098 B2 3/2009 Hartjes
7,513,386 B2 4/2009 Hartjes
7,514,517 B2 4/2009 Hoenig
7,524,911 B2 4/2009 Karjala
7,557,147 B2 7/2009 Martinez
7,579,408 B2 8/2009 Walton
7,582,716 B2 9/2009 Liang
7,585,557 B2 9/2009 Aylward
7,592,397 B2 9/2009 Markovich
7,608,668 B2 10/2009 Shan
7,622,179 B2 11/2009 Patel
7,622,529 B2 11/2009 Walton
7,629,416 B2 12/2009 Li
7,655,296 B2 2/2010 Haas
7,662,881 B2 2/2010 Walton
7,666,918 B2 2/2010 Prieto
7,671,106 B2 3/2010 Markovich
7,671,131 B2 3/2010 Hughes
7,673,564 B2 3/2010 Wolf
7,687,442 B2 3/2010 Walton
7,695,812 B2 4/2010 Peng
7,714,071 B2 5/2010 Hoenig
7,732,052 B2 6/2010 Chang
7,737,061 B2 6/2010 Chang
7,737,215 B2 6/2010 Chang
7,741,397 B2 6/2010 Liang
7,754,814 B2 7/2010 Barcus
7,759,404 B2 7/2010 Burgun
7,786,216 B2 8/2010 Soediono
7,795,321 B2 9/2010 Cheung
7,803,728 B2 9/2010 Poon
7,811,644 B2 10/2010 DeBraal
7,818,866 B2 10/2010 Hollis
7,820,282 B2 10/2010 Haas
7,825,166 B2 11/2010 Sasaki
7,841,974 B2 11/2010 Hartjes
7,842,770 B2 11/2010 Liang
7,858,706 B2 12/2010 Arriola
7,863,379 B2 1/2011 Kapur
7,883,769 B2 2/2011 Seth
7,893,166 B2 2/2011 Shan
7,897,689 B2 3/2011 Harris
7,906,587 B2 3/2011 Poon
7,910,658 B2 3/2011 Chang
7,915,192 B2 3/2011 Arriola
7,918,005 B2 4/2011 Hollis
7,918,016 B2 4/2011 Hollis
7,922,071 B2 4/2011 Robertson
7,928,162 B2 4/2011 Kiss
7,935,740 B2 5/2011 Dang
7,947,367 B2 5/2011 Poon
7,951,882 B2 5/2011 Arriola
7,977,397 B2 7/2011 Cheung
7,989,543 B2 8/2011 Karjala
7,993,254 B2 8/2011 Robertson
7,998,579 B2 8/2011 Lin
7,998,728 B2 8/2011 Rhoads
8,003,176 B2 8/2011 Ylitalo
8,003,744 B2 8/2011 Okamoto
8,012,550 B2 9/2011 Ylitalo
8,026,291 B2 9/2011 Handa
8,043,695 B2 10/2011 Ballard
8,067,319 B2 11/2011 Poon
8,076,381 B2 12/2011 Miyagawa
8,076,416 B2 12/2011 Ellul
8,084,537 B2 12/2011 Walton
8,087,147 B2 1/2012 Hollis
8,105,459 B2 1/2012 Alvarez
8,119,237 B2 2/2012 Peng
8,124,234 B2 2/2012 Weaver
8,173,233 B2 5/2012 Rogers
8,198,374 B2 6/2012 Arriola
8,211,982 B2 7/2012 Harris
8,227,075 B2 7/2012 Matsushita
8,273,068 B2 9/2012 Chang
8,273,826 B2 9/2012 Walton
8,273,838 B2 9/2012 Shan
8,288,470 B2 10/2012 Ansems
8,304,496 B2 11/2012 Weaver
8,404,780 B2 3/2013 Weaver
8,435,615 B2 5/2013 Tsuchida
8,679,620 B2 3/2014 Matsushita
8,715,449 B2 5/2014 Leser
8,721,823 B2 5/2014 Vaideeswaran
8,883,280 B2 * 11/2014 Leser et al. ..... 428/36.92
9,067,705 B2 6/2015 Leser
9,180,995 B2 11/2015 Iyori
9,358,772 B2 6/2016 Leser
2001/0010848 A1 8/2001 Usui
2001/0010849 A1 8/2001 Blizard
2001/0038893 A1 11/2001 Mohan
2001/0041236 A1 11/2001 Usui
2002/0030296 A1 3/2002 Geddes
2002/0041046 A1 4/2002 Hartjes
2002/0058126 A1 5/2002 Kannankeril
2002/0135088 A1 9/2002 Harfmann
2002/0137851 A1 9/2002 Kim
2002/0144769 A1 10/2002 Debraal
2002/0172818 A1 11/2002 DeBraal
2003/0003251 A1 1/2003 DeBraal
2003/0017284 A1 1/2003 Watanabe
2003/0021921 A1 1/2003 DeBraal
2003/0029876 A1 2/2003 Giraud
2003/0108695 A1 6/2003 Freek
2003/0138515 A1 7/2003 Harfmann
2003/0211310 A1 11/2003 Haas
2003/0228336 A1 12/2003 Gervasio
2003/0232210 A1 12/2003 Haas
2004/0013830 A1 1/2004 Nonomura
2004/0031714 A1 2/2004 Hanson
2004/0038018 A1 2/2004 Anderson
2004/0062885 A1 4/2004 Imanari
2004/0115418 A1 6/2004 Anderson
2004/0170814 A1 9/2004 VanHandel
2005/0003122 A1 1/2005 Debraal
2005/0006449 A1 1/2005 DAmato
2005/0101926 A1 5/2005 Ausen
2005/0104365 A1 5/2005 Haas
2005/0115975 A1 6/2005 Smith
2005/0121457 A1 6/2005 Wilson
2005/0124709 A1 6/2005 Krueger
2005/0145317 A1 7/2005 Yamamoto
2005/0147807 A1 7/2005 Haas
2005/0159496 A1 7/2005 Bambara
2005/0165165 A1 7/2005 Zwynenburg
2005/0184136 A1 8/2005 Baynum, III
2005/0236294 A1 * 10/2005 Herbert et al. ..... 206/518
2005/0256215 A1 11/2005 Burnham
2005/0272858 A1 12/2005 Pierini
2005/0288383 A1 12/2005 Haas
2006/0000882 A1 1/2006 Darzinskas
2006/0094577 A1 5/2006 Mannlein
2006/0095151 A1 5/2006 Mannlein
2006/0108409 A1 5/2006 Pyper
2006/0135679 A1 6/2006 Winowiecki
2006/0135699 A1 6/2006 Li
2006/0148920 A1 7/2006 Musgrave
2006/0151584 A1 7/2006 Wonnacott
2006/0178478 A1 8/2006 Ellul
2006/0198983 A1 9/2006 Patel
2006/0199006 A1 9/2006 Poon
2006/0199030 A1 9/2006 Liang

(56) References Cited

U.S. PATENT DOCUMENTS

| | | | |
|---|---|---|---|
| 2006/0199744 | A1 | 9/2006 | Walton |
| 2006/0199872 | A1 | 9/2006 | Prieto |
| 2006/0199884 | A1 | 9/2006 | Hoenig |
| 2006/0199887 | A1 | 9/2006 | Liang |
| 2006/0199896 | A1 | 9/2006 | Walton |
| 2006/0199897 | A1 | 9/2006 | Karjala |
| 2006/0199905 | A1 | 9/2006 | Hughes |
| 2006/0199906 | A1 | 9/2006 | Walton |
| 2006/0199907 | A1 | 9/2006 | Chang |
| 2006/0199908 | A1 | 9/2006 | Cheung |
| 2006/0199910 | A1 | 9/2006 | Walton |
| 2006/0199911 | A1 | 9/2006 | Markovich |
| 2006/0199912 | A1 | 9/2006 | Fuchs |
| 2006/0199914 | A1 | 9/2006 | Harris |
| 2006/0199930 | A1 | 9/2006 | Shan |
| 2006/0199931 | A1 | 9/2006 | Poon |
| 2006/0199933 | A1 | 9/2006 | Okamoto |
| 2006/0205833 | A1 | 9/2006 | Martinez |
| 2006/0211819 | A1 | 9/2006 | Hoenig |
| 2006/0234033 | A1 | 10/2006 | Nishikawa |
| 2006/0289609 | A1 | 12/2006 | Fritz |
| 2006/0289610 | A1 | 12/2006 | Kling |
| 2007/0000983 | A1 | 1/2007 | Spurrell |
| 2007/0010616 | A1 | 1/2007 | Kapur |
| 2007/0032600 | A1 | 2/2007 | Mogami |
| 2007/0056964 | A1 | 3/2007 | Holcomb |
| 2007/0065615 | A1 | 3/2007 | Odle |
| 2007/0066756 | A1 | 3/2007 | Poon |
| 2007/0078222 | A1 | 4/2007 | Chang |
| 2007/0095837 | A1 | 5/2007 | Meier |
| 2007/0112127 | A1 | 5/2007 | Soediono |
| 2007/0141188 | A1 | 6/2007 | Kim |
| 2007/0155900 | A1 | 7/2007 | Chang |
| 2007/0167315 | A1 | 7/2007 | Arriola |
| 2007/0167575 | A1 | 7/2007 | Weaver |
| 2007/0167578 | A1 | 7/2007 | Arriola |
| 2007/0202330 | A1 | 8/2007 | Peng |
| 2007/0219334 | A1 | 9/2007 | Shan |
| 2008/0020162 | A1 | 1/2008 | Fackler |
| 2008/0045638 | A1 | 2/2008 | Chapman |
| 2008/0118738 | A1 | 5/2008 | Boyer |
| 2008/0121681 | A1 | 5/2008 | Wiedmeyer |
| 2008/0138593 | A1 | 6/2008 | Martinez |
| 2008/0156857 | A1 | 7/2008 | Johnston |
| 2008/0177242 | A1 | 7/2008 | Chang |
| 2008/0227877 | A1 | 9/2008 | Stadlbauer |
| 2008/0234435 | A1 | 9/2008 | Chang |
| 2008/0260996 | A1 | 10/2008 | Heilman |
| 2008/0269388 | A1 | 10/2008 | Markovich |
| 2008/0280517 | A1 | 11/2008 | Chang |
| 2008/0281037 | A1 | 11/2008 | Karjala |
| 2008/0311812 | A1 | 12/2008 | Arriola |
| 2009/0042472 | A1 | 2/2009 | Poon |
| 2009/0068402 | A1 | 3/2009 | Yoshida |
| 2009/0069523 | A1 | 3/2009 | Itakura |
| 2009/0076216 | A1 | 3/2009 | Kiss |
| 2009/0096130 | A1 | 4/2009 | Jones |
| 2009/0105417 | A1 | 4/2009 | Walton |
| 2009/0110855 | A1 | 4/2009 | McCarthy |
| 2009/0110944 | A1 | 4/2009 | Aguirre |
| 2009/0170679 | A1 | 7/2009 | Hartjes |
| 2009/0220711 | A1 | 9/2009 | Chang |
| 2009/0247033 | A1 | 10/2009 | Peng |
| 2009/0263645 | A1 | 10/2009 | Barger |
| 2009/0275690 | A1 | 11/2009 | Weaver |
| 2009/0324914 | A1 | 12/2009 | Lieng |
| 2010/0025073 | A1 | 2/2010 | Fagrell |
| 2010/0028568 | A1 | 2/2010 | Weaver |
| 2010/0029827 | A1 | 2/2010 | Ansems |
| 2010/0040818 | A1 | 2/2010 | Farha |
| 2010/0055358 | A1 | 3/2010 | Weaver |
| 2010/0069574 | A1 | 3/2010 | Shan |
| 2010/0093942 | A1 | 4/2010 | Silvis |
| 2010/0116422 | A1 | 5/2010 | Vaideeswaran |
| 2010/0137118 | A1 | 6/2010 | Chang |
| 2010/0168267 | A1 | 7/2010 | Dang |
| 2010/0181328 | A1 | 7/2010 | Cook |
| 2010/0181370 | A1 | 7/2010 | Berbert |
| 2010/0196610 | A1 | 8/2010 | Chang |
| 2010/0240818 | A1 | 9/2010 | Walton |
| 2010/0279571 | A1 | 11/2010 | Poon |
| 2010/0324202 | A1 | 12/2010 | Bafna |
| 2011/0003929 | A1 | 1/2011 | Soediono |
| 2011/0008570 | A1 | 1/2011 | Seth |
| 2011/0009513 | A1 | 1/2011 | Chaudhary |
| 2011/0014835 | A1 | 1/2011 | Sieradzki |
| 2011/0091688 | A1 | 4/2011 | Maurer |
| 2011/0104414 | A1 | 5/2011 | Onodera |
| 2011/0111150 | A1 | 5/2011 | Matsuzaki |
| 2011/0118370 | A1 | 5/2011 | Jiang |
| 2011/0118416 | A1 | 5/2011 | Arriola |
| 2011/0124818 | A1 | 5/2011 | Arriola |
| 2011/0136959 | A1 | 6/2011 | Brandstetter |
| 2011/0144240 | A1 | 6/2011 | Harris |
| 2011/0217492 | A1 | 9/2011 | Stamatiou |
| 2011/0229693 | A1 | 9/2011 | Maurer |
| 2011/0230108 | A1 | 9/2011 | Arriola |
| 2011/0318560 | A1 | 12/2011 | Yun |
| 2012/0004087 | A1 | 1/2012 | Tharayil |
| 2012/0024873 | A1 | 2/2012 | Roseblade |
| 2012/0028065 | A1 | 2/2012 | Bafna |
| 2012/0041148 | A1 | 2/2012 | Bafna |
| 2012/0043374 | A1 | 2/2012 | Lemon |
| 2012/0045603 | A1 | 2/2012 | Zerafati |
| 2012/0108714 | A1 | 5/2012 | Wittner |
| 2012/0108743 | A1 | 5/2012 | Krishnaswamy |
| 2012/0125926 | A1 | 5/2012 | Iyori |
| 2012/0132699 | A1 | 5/2012 | Mann |
| 2012/0178896 | A1 | 7/2012 | Bastioli |
| 2012/0184657 | A1 | 7/2012 | Lake |
| 2012/0193365 | A1 | 8/2012 | Humphries |
| 2012/0199278 | A1 | 8/2012 | Lee |
| 2012/0199279 | A1 | 8/2012 | Lee |
| 2012/0199641 | A1 | 8/2012 | Hsieh |
| 2012/0214890 | A1 | 8/2012 | Senda |
| 2012/0220730 | A1 | 8/2012 | Li |
| 2012/0225961 | A1 | 9/2012 | VanHorn |
| 2012/0237734 | A1 | 9/2012 | Maurer |
| 2012/0267368 | A1 | 10/2012 | Wu |
| 2012/0270039 | A1 | 10/2012 | Tynys |
| 2012/0295994 | A1 | 11/2012 | Bernreitner |
| 2012/0318805 | A1 | 12/2012 | Leser |
| 2012/0318807 | A1 | 12/2012 | Leser |
| 2012/0318859 | A1 | 12/2012 | Leser |
| 2013/0023598 | A1 | 1/2013 | Song |
| 2013/0032963 | A1 | 2/2013 | Tokiwa |
| 2013/0052385 | A1 | 2/2013 | Leser |
| 2013/0140320 | A1 | 6/2013 | Nadella |
| 2013/0216744 | A1 | 8/2013 | Liao |
| 2013/0280517 | A1 | 10/2013 | Buehring |
| 2013/0303645 | A1 | 11/2013 | Dix |
| 2014/0131430 | A1 | 5/2014 | Leser |
| 2014/0263367 | A1 | 9/2014 | Robertson |
| 2015/0250342 | A1 | 9/2015 | Euler |
| 2015/0258771 | A1 | 9/2015 | Leser |

FOREIGN PATENT DOCUMENTS

| | | |
|---|---|---|
| CA | 2765489 | 12/2010 |
| CN | 1288427 | 3/2001 |
| CN | 1495100 | 5/2004 |
| CN | 1942370 | 4/2007 |
| CN | 101370873 | 2/2009 |
| CN | 101429309 | 5/2009 |
| CN | 101531260 | 9/2009 |
| CN | 101538387 | 9/2009 |
| CN | 102089370 | 6/2011 |
| CN | 102115561 | 7/2011 |
| CN | 102245368 | 11/2011 |
| CN | 102391570 | 3/2012 |
| CN | 102762350 | 10/2012 |
| DE | 2831240 | 1/1980 |
| DE | 2831240 C | 3/1988 |
| DE | 102006025612 | 11/2007 |

(56) References Cited

FOREIGN PATENT DOCUMENTS

| | | | |
|---|---|---|---|
| DE | 102006025612 | A1 | 11/2007 |
| EP | 0001791 | | 5/1979 |
| EP | 0086869 | | 8/1983 |
| EP | 0161597 | | 11/1985 |
| EP | 0318167 | | 5/1989 |
| EP | 0520028 | | 12/1992 |
| EP | 0570221 | | 11/1993 |
| EP | 0588321 | | 3/1994 |
| EP | 0659647 | | 6/1995 |
| EP | 0879844 | | 11/1998 |
| EP | 0972727 | | 1/2000 |
| EP | 0796199 | | 2/2001 |
| EP | 0940240 | | 10/2002 |
| EP | 1308263 | | 5/2003 |
| EP | 1323779 | | 7/2003 |
| EP | 1479716 | | 11/2004 |
| EP | 1666530 | | 6/2006 |
| EP | 1754744 | | 2/2007 |
| EP | 1921023 | A1 | 5/2008 |
| EP | 1939099 | | 7/2008 |
| EP | 2266894 | | 12/2010 |
| EP | 2386584 | A1 | 11/2011 |
| EP | 2386601 | | 11/2011 |
| EP | 2720954 | | 4/2014 |
| GB | 1078326 | | 8/1967 |
| GB | 2485077 | | 5/2012 |
| JP | 52123043 | | 10/1977 |
| JP | 52123043 | U | 10/1977 |
| JP | S5641146 | A | 4/1981 |
| JP | 58029618 | | 2/1983 |
| JP | H02129040 | U | 5/1990 |
| JP | H02269683 | | 11/1990 |
| JP | H0543967 | | 6/1993 |
| JP | 0615751 | | 1/1994 |
| JP | 3140847 | | 1/1994 |
| JP | 06192460 | | 7/1994 |
| JP | H08067758 | | 3/1996 |
| JP | 2000128255 | | 5/2000 |
| JP | P310847 | | 12/2000 |
| JP | 2001310429 | | 11/2001 |
| JP | 2001315277 | | 11/2001 |
| JP | 2003292663 | | 10/2003 |
| JP | 2003321566 | | 11/2003 |
| JP | 2004018101 | | 1/2004 |
| JP | 2004168421 | | 6/2004 |
| JP | 2004168421 | A | 6/2004 |
| JP | 2004330464 | | 11/2004 |
| JP | 2005272542 | | 10/2005 |
| JP | 2006096390 | | 4/2006 |
| JP | 2006130814 | A | 5/2006 |
| JP | 2006142008 | A | 6/2006 |
| JP | 2007154172 | | 6/2007 |
| JP | 2008162700 | | 7/2008 |
| JP | 2009504858 | | 2/2009 |
| JP | 2009066856 | A | 4/2009 |
| JP | 2009126922 | | 6/2009 |
| JP | 2009138029 | | 6/2009 |
| JP | 2009190756 | A | 8/2009 |
| JP | 2010173258 | | 8/2010 |
| JP | 2011104890 | | 6/2011 |
| KR | 100306320 | | 10/2001 |
| KR | 2003036558 | | 5/2003 |
| KR | 2004017234 | | 2/2004 |
| KR | 101196666 | | 11/2012 |
| TW | 393427 | | 6/2000 |
| TW | M362648 | | 8/2009 |
| TW | 201021747 | | 6/2010 |
| WO | 9113933 | | 9/1991 |
| WO | 9413460 | | 6/1994 |
| WO | 9729150 | | 8/1997 |
| WO | 9816575 | | 4/1998 |
| WO | 0002800 | | 1/2000 |
| WO | 0119733 | | 3/2001 |
| WO | 0132758 | | 5/2001 |
| WO | 0153079 | | 7/2001 |
| WO | 0234824 | | 5/2002 |
| WO | 03076497 | | 9/2003 |
| WO | 03099913 | | 12/2003 |
| WO | 2004104075 | | 12/2004 |
| WO | 2006042908 | | 4/2006 |
| WO | 2006124369 | | 11/2006 |
| WO | 2007003523 | | 1/2007 |
| WO | 2007020074 | | 2/2007 |
| WO | 2007068766 | | 6/2007 |
| WO | 2007090845 | A2 | 8/2007 |
| WO | 2008030953 | | 3/2008 |
| WO | 2008038750 | | 4/2008 |
| WO | 2008045944 | | 4/2008 |
| WO | 2008057878 | | 5/2008 |
| WO | 2008080111 | | 7/2008 |
| WO | 2008145267 | | 12/2008 |
| WO | 2009035580 | | 3/2009 |
| WO | 2010006272 | | 1/2010 |
| WO | 2010019146 | | 2/2010 |
| WO | 2010076701 | A1 | 7/2010 |
| WO | 2010111869 | | 10/2010 |
| WO | 2011005856 | | 1/2011 |
| WO | 2011036272 | | 3/2011 |
| WO | 2011036272 | A2 | 3/2011 |
| WO | 2011038081 | | 3/2011 |
| WO | 2011076637 | | 6/2011 |
| WO | 2011141044 | | 11/2011 |
| WO | 2011144705 | | 11/2011 |
| WO | 2012020106 | | 2/2012 |
| WO | 2012025584 | | 3/2012 |
| WO | 2012044730 | | 4/2012 |
| WO | 2012055797 | | 5/2012 |
| WO | 2012099682 | | 7/2012 |
| WO | 2012173873 | | 12/2012 |
| WO | 2012174422 | | 12/2012 |
| WO | 2012174567 | | 12/2012 |
| WO | 2012174568 | | 12/2012 |
| WO | 2013032552 | | 3/2013 |
| WO | 2013101301 | | 7/2013 |

OTHER PUBLICATIONS

Office Action dated Aug. 19, 2014 for Chinese Application No. 201280035667.4.

Office Action dated Aug. 21, 2014 for U.S. Appl. No. 13/526,454.

Office Action dated Jul. 25, 2014 for U.S. Appl. No. 13/525,640.

Office Action dated Sep. 25, 2014 for U.S. Appl. No. 13/526,417.

International Search Report and Written Opinion dated Apr. 16, 2014, relating to International Application No. PCT/US2013/075013.

International Search Report and Written Opinion dated Apr. 21, 2014, relating to International Application No. PCT/US2013/074923.

International Search Report and Written Opinion dated Apr. 22, 2014, relating to PCT/US2013/074965.

International Search Report and Written Opinion dated Apr. 25, 2014, relating to PCT/US2013/075052.

International Search Report dated Mar. 11, 2014, relating to International Application No. PCT/US2013/66811.

International Search Report dated Jul. 29, 2013, relating to International Application No. PCT/US2012/043016, 25 pages.

International Search Report and Written Opinion dated Sep. 17, 2013, relating to International Application No. PCT/US2012/041395.

International Search Report dated Feb. 26, 2013, relating to International Application No. PCT/US2012/043018.

International Search Report dated Jan. 29, 2013, relating to International Application No. PCT/US2012/043017.

International Search Report dated Jan. 30, 2013, relating to International Application No. PCT/US2012/042737.

International Search Report dated Jul. 30, 2012, relating to International Application No. PCT/US2012/041397.

International Search Report dated Nov. 19, 2012, relating to International Application No. PCT/US2012/041395.

(56) References Cited

OTHER PUBLICATIONS

Jaakko I. Raukola, A New Technology to Manufacture Polypropylene Foam Sheet and Biaxially Oriented Foam Film, VTT Publications 361, Technical Research Centre of Finland, Apr. 1998, 100 pages.
Borealis AG, Daploy(TM) HMS Polypropylene for Foam Extrusion, 2010, 20 pages.
Machine English translation of JP 2006-130814.
International Search Report and Written Opinion dated Jul. 3, 2014, relating to International Application No. PCT/US2014/025697.
Office Action dated Oct. 10, 2014 for U.S. Appl. No. 14/106,358.
New Zealand First Examination Report for Application No. 619616 dated Oct. 10, 2014.
International Search Report and Written Opinion dated Jan. 19, 2015, relating to International Application No. PCT/US2014/059312.
International Search Report dated Jan. 19, 2015, relating to International Application No. PCT/US2014/059216.
Office Action dated Feb. 2, 2015 for U.S. Appl. No. 14/106,114.
Office Action dated Jan. 6, 2015 for Chinese Application No. 201280034350.9 (11 pages).
Office Action dated Jan. 9, 2015 for Chinese Application No. 201280035667.4 (22 pages).
Spanish Search Report of Application No. 201390099, dated Feb. 9, 2015.
European Search Report of Application No. 12861450.0, dated Nov. 21, 2014.
International Search Report dated Nov. 7, 2014, relating to International Application No. PCT/US2014/51508.
New Zealand First Examination Report for Application No. 621219 dated Nov. 17, 2014.
Third-Party Submission Under 37 CFR 1.290 filed on Dec. 9, 2014 in U.S. Appl. No. 14/063,252.
Australian First Patent Examination Report for Application No. 2012302251 dated Jul. 9, 2015.
Machine English translation of EP0086869.
Singapore Office Action dated Dec. 18, 2014 for Singapore Application No. 2014002273.
Third-Party Submission Under 37 CFR 1.290 filed on Feb. 26, 2015 in U.S. Appl. No. 13/491,007.
Certified English translation of EP0086869.
Office Action dated Apr. 30, 2015 for U.S. Appl. No. 14/462,073.
Office Action dated Apr. 10, 2015 for U.S. Appl. No. 14/106,358.
English translation of Spanish Search Report of Application No. 201490025, dated Apr. 20, 2015.
Spanish Search Report for Application No. 201490025, dated Apr. 20, 2015.
Office Action dated Jun. 23, 2015 for U.S. Appl. No. 13/525,640.
Third Party Submission Under 37 CFR 1.290 in U.S. Appl. No. 14/188,504 submitted May 11, 2015 and May 27, 2015 (43 pages).
Naguib et al., "Fundamental Foaming Mechanisms Governing the Volume Expansion of Extruded Polypropylene Foams," Journal of Applied Polymer Science, vol. 91, pp. 2661-2668, 2004 (10 pages).
Wang et al., "Extending PP\s Foamability Through Tailored Melt Strength and Crystallization Kinetics," paper 19 from the Conference Proceedings of the 8th International Conferences of Blowing Agents and Foaming Processes, May 16-17, 2006 in Munich, Germany Smithers Rapra Ltd, 2006 (14 pages).
Inter Partes Review Petition for U.S. Pat. No. 8,883,280 (712 pages).
Borealis webpage dated Jan. 20, 2010 from Internet Archive (6 pages).
Gibson and Ashby, Cellular solids: structure and properties, 2nd ed., Cambridge University Press (1997) (7 pages).
C. Maier and T. Calafut, Polypropylene: the Definitive User\s Guide and Databook, Plastics Design Library, William Andrew Inc. (1998) (19 pages).
Reichelt et al., Cellular Polymers, vol. 22, No. 5 (2003) (14 pages).
Ratzsch et al., Prog. Polym. Sci., 27 (2002), 1195-1282 (88 pages).
Encyclopedia of Polymer Science and Technology: Plastics, Resins, Rubbers, and Fibers, vol. 2, John Wiley & Sons, Inc. (1965) (37 pages).
Shau-Tarng Lee, Chul B. Park, and N.S. Ramesh, Polymer Foams: Science and Technology, CRC Press (2007) (51 pages).
Grant & Hackh\s Chemical Dictionary, 5th ed., McGraw-Hill, Inc. (1987) (3 pages).
Merriam-Webster\s Collegiate Dictionary, 11th ed. (2003), p. 70 (3 pages).
Merriam-Webster\s Collegiate Dictionary, 11th ed. (2003), p. 1237 (3 pages).
Hawley\s Condensed Chemical Dictionary, 14th Ed. (2001) (5 pages).
Reichelt et al., Abstract of PP-Blends with Tailored Foamability and Mechanical Properties, Cellular Polymers, (2003) available from http://www.polymerjournals.com/journals.asp?Page=111 &JournalType=cp&JournalIssue=cp22-5&JIP=, listing (4 pages).
Ratzsch et al., Abstract of Radical Reactions on Polypropylene in the Solid State, Progress in Polymer Science, vol. 27, Issue 7, (Sep. 2002), available from http://www.sciencedirect.com/science/article/pii/S0079670002000060 (3 pages).
"Borealis Dapoly HMS Polypropylene for Foam Extrusion" obtained from Borealis webpage obtained from the Internet Archive\s "Wayback Machine" as of Nov. 16, 2008 (https://web.archive.org/web/20081116085125/http://www.borealisgroup.com/pdf/literature/borealis-borouge/brochure/K_IN0020_GB_FF_2007_10_BB.pdf) ("Brochure \08") (20 pages).
Office Action dated May 19, 2015 for Chinese Application No. 201280035667.4.
Office Action Chinese Patent Application No. 201280051426.9 dated Jul. 23, 2015.
Office Action dated Aug. 27, 2015 for U.S. Appl. No. 14/106,358.
Certified English translation of JP2003292663.
Office Action dated Oct. 8, 2015 for U.S. Appl. No. 14/188,504.
Second Chinese Office Action dated Sep. 6, 2015 for Chinese Application Serial No. 201280034350.9.
Office Action dated Oct. 27, 2015 for U.S. Appl. No. 14/462,073.
Third Party Observations filed with respect to European Patent Application No. 12727994.1, dated Aug. 17, 2015 (22 pages).
U.S. Appl. No. 61/498,455, filed Jun. 17, 2011, related to PCT Application No. PCT/US2012/041395, 46 pages.
"Slip Agents", Polypropylene Handbook, 2nd edition, 2005, pp. 285-286.
English translation of Russian Office Action for Application Serial No. 2015127677, dated Sep. 16, 2015.
Office Action dated Dec. 31, 2015 for U.S. Appl. No. 14/755,546.
Notice of Allowance dated Jan. 29, 2016 for U.S. Appl. No. 14/755,546.
English translation of First Office Action for Taiwanese Application No. 101121656, dated Nov. 13, 2015.
Singapore Notice of Eligibility for Grant, Search Report, and Examination Report dated Dec. 10, 2015 for Singapore Application No. 11201503336V.
Office Action dated Jan. 11, 2016 for U.S. Appl. No. 14/161,328.
Office Action for Chinese Patent Application No. 201380065116.7, dated Jun. 28, 2016, including English language summary, 12 pages.
Australian First Patent Examination Report for Application No. 2013334155, dated May 23, 2016, 4 pages.
Extended European Search Report for European Application No. 13862331.9-1708 / 2931627 PCT/US2013/074923, dated Jul. 7, 2016.
English translation of Russian Office Action for Application Serial No. 2014101298, dated Jul. 22, 2016, 7 pages.
English Summary of Russian Office Action for Application Serial No. 2014111340, dated Feb. 25, 2016, 8 pages.
United Kingdom Examination Report for Patent Application No. GB1400762.9 dated Feb. 11, 2016.
Office Action dated Feb. 16, 2016 for U.S. Appl. No. 14/108,142.
Extended European Search Report for European Application No. 13849152.7-1303 / 2912142 PCT/US2013/066811, dated Feb. 12, 2016.
English summary of Spanish Office Action for Application Serial No. P201490025, dated Feb. 9, 2016, 8 pages.

(56) References Cited

OTHER PUBLICATIONS

Supplemental European Search Report for European Application No. 12727994.1-1302, dated Feb. 17, 2016.
English summary of Chinese Office Action for Chinese Application Serial No. 201380065781.6, dated Apr. 19, 2016, 14 pages.
Affidavit of Christopher Butler of Internet Archive, Borealis webpage dated Jan. 20, 2010 (https://web.archive.org/web/20100120102738/http://www.borealisgroup.com/industry-solutions/advancedpackaging/rigid-packaging/polyolefin-foam/daploy-hmspp-extruded-foam/).
Reichelt et al., "PP-Blends with Tailored Foamability and Mechanical Properties", Cellular Polymers, vol. 22, No. 5, 2003, 14 pages.
Ratzsch et al., "Radical reactions on polypropylene in the solid state", Prog. Polym. Sci. 27 (2002) 1195-1282, 88 pages.
Excerpts from Encyclopedia of Polymer Science and Technology: Plastics, Resins, Rubbers, and Fibers, "Blowing Agents", vol. 2, John Wiley & Sons, Inc. (1965), 37 pages.
Excerpts from Polymer Foams: Science and Technology, Lee et al., "Introduction to Polymeric Foams", CRC Press (2007) 51 pages.
"Daploy(TM) HMS Polypropylene for Foam Extrusion", obtained from Borealis webpage obtained from the Internet Archive\s "Wayback Machine" as of Nov. 16, 2008 https://web.archive.org/web/20081116085125/http://www.borealisgroup.com/pdf/literature/borealisborouge/brochure/K_IN0020_GB_FF_2007_10_BB.pdf).
Excerpts from Gibson and Ashby, Cellular solids: Structure and properties—Second edition, Cambridge University Press, 1997, 66 pages.
Excerpts from Maier and Calafut, Polypropylene: the Definitive User's Guild and Databook, Plastics Design Library, William Andrew Inc. (1998), 35 pages.
ASTM D3763-86, an American Society for Testing of Materials (ASTM), "Standard Method for High-Speed Puncture Properties of Plastics Using Load and Displacement Sensors" (1986 Edition), 5 pages.
ASTM D1922-93, an American Society for Testing of Materials (ASTM), "Standard Method for Propagation Tear Resistance of Plastic Film and Thin Sheeting by Pendulum Method" (1993 Edition), 5 pages.
Naguib et al., "Effect of Supercritical Gas on Crystallization of Linear and Branched Polypropylene Resins with Foaming Additives", Ind. Eng. Chem. Res., 44 (2005), 6685-6691.
Tabatabaei et al., "Rheological and thermal properties of blends of a long-chain branched polypropylene and different linear polypropylenes", Chemical Engineering Science, 64 (2009), 4719-4731.
Almanza et al., "Applicability of the Transient Plane Source Method to Measure the Thermal Conductivity of Low-Density Polyethylene Foams", Journal of Polymer Science: Part B: Polymer Physics, vol. 42 (2004), 1226-1234.
The Burn Foundation, "Scald Burns", available at https://web.archive.org/web/20080926114057/http:/wwwvii.burnfoundation.org/programs/resource.cfm?c=1&a=3, dated Sep. 26, 2008, accessed on Feb. 5, 2016.
AntiScald Inc. available at https://web.archive.org/web/20080517041952/http:/www.antiscald.com/prevention/general_info/table.php, dated May 17, 2008, accessed on Feb. 5, 2016.
"Fire Dynamics", available at http://www.nist.gov/fire/fire_behavior.cfm, accessed on Feb. 5, 2016.
"Power of a Microwave Oven", available at https://web.archive.org/web/20071010183358/http://hypertextbook.com/facts/2007/TatyanaNektalova.shtml, dated Oct. 10, 2007, accessed on Feb. 5, 2016.
Health Physics Society, "Microwave Oven Q & A", available at https://web.archive.org/web/20090302090144/http://www.hps.org/publicinformation/ate/faqs/microwaveovenq&a.html, dated Mar. 2, 2009, accessed on Feb. 5, 2016.
Cook's Info, "Microwave Ovens", available at http://www.cooksinfo.com/microwave-ovens, accessed on Feb. 5, 2016.
Antunes et al., "Heat Transfer in Polypropylene-Based Foams ProducedUsing Different Foaming Processes", Advanced Engineering Materials, 11, No. 10 (2009), 811-817.
Excerpts from Frank Kreith, Principles of Heat Transfer, 3rd ed., Intext Educational Publishers (1973).
Excerpts from James M. Gere, Mechanics of Materials, 5th ed., Brooks/Cole (2001).
Technical data sheet of HIFAX CA 60 A, obtained from https://www.lyondellbasell.com/en/polymers/p/Hifax-CA-60-A/d372c484-8f5a-4b2c-8674-8b7b781a1796, accessed on Feb. 4, 2016, 2 pages.
Michel Biron, "Chapter 4—Detailed Accounts of Thermoplastic Resins," Thermoplastics and Thermoplastic Composites, Technical Information for Plastics Users, Elsevier Ltd. (2007), 217-714.
Excerpts from Cornelia Vasile, "Mechanical Properties and Parameters of Polyolefins", Handbook of Polyolefins, 2nd ed., Marcel Dekker, Inc. (2000).
Williams et al., "Thermal Connectivity of Plastic Foams", Polymer Engineering and Science, Apr. 1983, vol. 23, No. 6., 293-298.
Excerpts from M.C. McCrum et al., Principles of Polymer Engineering, 2nd ed., Oxford Science Publications (1997).
Excerpts from Robert H. Perry, Perry\s Chemical Engineers Handbook, 7th ed., The McGraw-Hill Companies, Inc. (1997).
Martinez-Diez et al., "The Thermal Conductivity of a Polyethylene Foam Block Produced by a Compression Molding Process", Journal of Cellular Plastics, vol. 37 (2001), 21-42.
Borealis Product Brochure, Daploy HMS Polypropylene for Foam Extrusion (2010), 20 pages.
R. Coquard and D. Baillis, Journal of Heat Transfer, 2006, 128(6): 538-549.
A. R. Katritzky et al., "Correlation and Prediction of the Refractive Indices of Polymers by QSPR," J. Chem. Inf. Comput. Sci., 38 (1998), 1171-1176.
M. Antunes et al., "Heat Transfer in Polyolefin Foams," Heat Transfer in Multi-Phase Materials, A. Öchsner and G. E. Murch, Eds. Springer-Verlag Berlin Heidelberg, 2011, 131-161.
Inter Partes Review Petition for U.S. Pat. No. 8,883,280 (2101 pages) [Submitted in multiple parts—section 1].
Inter Partes Review Petition for U.S. Pat. No. 8,883,280 (2101 pages) [Submitted in multiple parts—section 2].
Inter Partes Review Petition for U.S. Pat. No. 8,883,280 (2101 pages) [Submitted in multiple parts—section 3].
Inter Partes Review Petition for U.S. Pat. No. 8,883,280 (2101 pages) [Submitted in multiple parts—section 4].
English summary of Mexican Office Action for Application Serial No. MX/a/2013/014993, dated Apr. 27, 2016, 5 pages.
Japanese Office Action for Japanese Patent Application No. 2014-528384, dated Mar. 1, 2016.
International Preliminary Report on Patentability dated Feb. 16, 2016, relating to International Application No. PCT/US2014/051508.
English Summary of Chinese Office Action for Application Serial No. 201380041896.1, dated Mar. 18, 2016, 7 pages.
Extended European Search Report for European Application No. 13827981.5-1708 / 2888092 PCT/US2013/053935, dated Feb. 19, 2016.
Australian First Patent Examination Report for Application No. 2012271047, dated Feb. 29, 2016.
N.N. Najib, N.M. Manan, A.A. Bakar, and C.S. Sipaut, Effect of Blowing Agent Concentration on Cell Morphology and Impact Properties of Natural Rubber Foam, Journal of Physical Science, vol. 20(1), 13-25, 2009 (13 pages).
Nigel Mills, Polymer Foams Handbook, Fig. 2.2, 1st ed. 2007 (2 pages).
University of Massachusetts , Advanced Plastics Processing Lecture, Lecture 11: Foam Processes, Slide 4 (Nov. 11, 2012) (2 pages).
Australian Second Patent Examination Report for Application No. 2012302251, dated Feb. 26, 2016.
Doerpinghaus et al., "Separating the effects of sparse long-chain branching on rheology from those due to molecular weight in polyethylenes", Journal of Rheology, 47, 717 (2003).
English Summary of Chinese Office Action for Application Serial No. 201280051426.9, dated Apr. 29, 2016, 5 pages.

(56) References Cited

OTHER PUBLICATIONS

English translation of Japanese Office Action for Japanese Application No. 2014-516089, dated May 10, 2016.
Third Party Submission Under 37 CFR 1.290 filed on May 12, 2016 in U.S. Appl. No. 14/739,510.
Daploy HMS Polypropylene for Foam Extrusion, 20 pages, Borealis Borouge Shaping the Future with Plastics, Published 2010, www.borealisgroup.com, www.borouge.com, Vienna, Austria.
Lugao, A.B. et al., HMSPP—New Developments, Chemical and Environmental Technology Center, IPEN—Progress Report, 2002-2004 (1 page).
Davesh Tripathi, Practical Guide to Polypropylene, 2002 (5 pages).
Jinghua Tian et al., The Preparation and Rheology Characterization of Long Chain Branching Polypropylene, Polymer, 2006 (9 pages).
Bc. Lukas Kovar, High Pressure Crystallization of Long Chain Branched Polypropylene, Master Thesis, Thomas Bata University in Zlin, 2010 (83 pages).
Office Action dated Jun. 30, 2016 for U.S. Appl. No. 14/106,276.
Australian First Patent Examination Report for Application No. 2012363114, dated Jun. 15, 2016, 4 pages.
Office Action for Chinese Patent Application No. 201380064860.5, dated Jun. 2, 2016 including English language summary, 13 pages.
Singapore Office Action and Written Opinion dated May 26, 2016 for Singapore Application No. 11201504333Y.
Singapore Office Action and Written Opinion dated May 27, 2016 for Singapore Application No. 11201504330U.
Singapore Office Action and Written Opinion dated May 27, 2016 for Singapore Application No. 11201504327V.
Office Action dated Jun. 10, 2016 for U.S. Appl. No. 14/188,504.
Office Action dated Mar. 10, 2016 for U.S. Appl. No. 14/620,073.
Notice of Acceptance dated Jun. 10, 2016 for Australian Application No. 2012302251.
International Search Report and Written Opinion dated Oct. 18, 2013, relating to International Application No. PCT/US2013/053935.
English Summary of Chinese Office Action for Application Serial No. 201380041896.1, dated Mar. 21, 7 pages.
Australian First Patent Examination Report for Application No. 2013359097 dated Aug. 26, 2016, 3 pages.
British Examamination Report for GB Application No. GB1400762.9, dated Aug. 8, 2016, 2 pages.
Extended European Search Report for European Application No. 13863546.1 dated Jul. 12, 2016, 7 pages.
Office Action dated Aug. 9, 2016 for U.S. Appl. No. 14/108,142.
Jacoby, Philip, "Recent Insights on the Use of Beta Nucleation to Improve the Thermoforming Characteristics of Polypropylene," Society of Plastics Engineers, Annual Technical Conference Proceedings, ANTEC 2012, Apr. 2012, pp. 2292-2296.
Singapore Written Opinion for Singapore Patent Application No. 11201504756T dated Jul. 19, 2016, 7 pages.
Office Action dated Sep. 27, 2016 for U.S. Appl. No. 14/725,319.
Japanese Office Action for Japanese App. No. 2014-528384 dated Dec. 6, 2016, 15 pages.
Singapore Office Action and Written Opinion dated Feb. 6, 2017 for Singapore Application No. 1120150430U, 6 pages.
Office Action dated Feb. 7, 2017 for U.S. Appl. No. 13/491,007.
Office Action for Chinese Patent Application No. 201380064860.5, dated Jan. 25, 2017, 12 pages.
European Examination Report for European App. No. 13849152.7 dated Jan. 30, 2017, 3 pages.
Office Action dated Feb. 15, 2017 for U.S. Appl. No. 14/858,193.
Singapore Office Action and Written Opinion dated Feb. 14, 2017 for Singapore Application No. 11201504327V, 6 pages.
Office Action dated Jan. 4, 2017 for U.S. Appl. No. 14/108,110.
Spanish Search Report for Spanish App. No. 201490025 dated Dec. 23, 2016, 5 pages.
Japanese Office Action for Japanese Patent App. 2014-516089 dated Dec. 20, 2016, 6 pages.
European Examination Report for European App. No. 12727994.1 dated Jan. 25, 2016, 4 pages.
Taiwan Office Action for Taiwan Pat. App. No. 102146299 dated Oct. 21, 2016, 7 pages.
Third Party Observation filed in European Patent App. No. 12727994.1 dated Nov. 4, 2016, 11 pages.
International Standard ISO 16790:2005(E), 20 pages.
S. Muke et al., The Melt Extensibility of Polypropylene, Polym. Int. 2001,515-523, 9 pages.
P. Spitael and C.W. Macosko, Strain Hardening in Polypropylenes and its Role in Extrusion Foaming, Polym. Eng. Sci. 2004, 2090-2100.
Combined Search and Examination Report for Great Britain App. No. GB1616321.4 dated Oct. 12, 2016, 4 pages.
British Examination Report for GB App. No. 1400762.9 dated Oct. 12, 2016, 2 pages.
Chinese Office Action for Chinese Applicaiton 201380065781.6 dated Oct. 18, 2016, 33 pages.
Research Progress of Polypropylene Foamed Material, Baiquan Chen et al., Plastics Manufacture, No. 12, pp. 55-58.
Modification and Formulation of Polypropylene, Mingshan Yang edits, Chemical Industry Press, p. 43, the second paragraph from the bottom, Jan. 31, 2009.
Extended European Search Report for European App. No. 13863649.3 dated Sep. 27, 2016, 9 pages.
Office Action dated Nov. 4, 2016 for U.S. Appl. No. 13/961,411.
Chinese Office Action for Chinese Application No. 201280051426.9 dated Nov. 1, 2016, 9 pages.
English Summary of Chinese Office Action for Application Serial No. 201380041896.1, dated Nov. 11, 2016, 11 pages.
Extended European Search Report for European App. No. 14775300.8 dated Oct. 24, 2016, 9 pages.
Office Action dated Nov. 18, 2016 for U.S. Appl. No. 14/718,836.
Typical Engineering Properties of Polypropylene information sheet, Ineos Olefins and Polymers USA, archived at https://web.archive.org/web/20160501000000*/http://www.ineos.com/globalassets/ineos-group/businesses/ineos-olefins-and-polymers-usa/products/technical-information-patents/ineos-engineering-properties-of-pp.pdf, Mar. 2016, p. 1.
Office Action dated Dec. 14, 2016 for U.S. Appl. No. 14/211,553.
Office Action dated Dec. 22, 2016 for U.S. Appl. No. 14/858,158.
Gulf Cooperation Council Examination Report for GCC Patent App. No. GC2012-21529 dated Nov. 14, 2016, 6 pages.
Office Action dated Dec. 28, 2016 for U.S. Appl. No. 14/106,276.
Office Action dated Oct. 7, 2016 for U.S. Appl. No. 14/739,510.
Japanese Office Action for Japanese Application No. 2014-515882, dated Aug. 30, 2016, 6 pages.
Mexican Office Action for Mexican Application MX/a/2013/014993 dated Sep. 27, 2016, 6 pages.
New Zealand Examination Report for New Zealanc Application No. 708463 dated Oct. 3, 2016, 3 pages.
New Zealand Examination Report for New Zealand Application No. 708552 dated Oct. 7, 2016, 4 pages.
New Zealand First Examination Report for New Zealand Application 708546 dated Sep. 26, 2016, 4 pages.
Russian Office Action for Russian Application No. 2014101298 dated Sep. 30, 2016, 6 pages.
European Examination Report for European App. No. 12727994.1 dated Sep. 23, 2016, 4 pages.
Chinese Office Action for Chinese App. No. 201380065089.3 dated Sep. 30, 2016, 12 pages.
Chinese Office Action for Chinese App. No. 201380065127.5 dated Jul. 26, 2016, 11 pages.
European Search Report for European App. No. 13849152.7 dated Sep. 16, 2016, 3 pages.
Australian Patent Examination Report for Australian App. No. 2013334155 dated Oct. 24, 2016, 7 pages.
Singapore Office Action and Written Opinion dated Dec. 13, 2016 and received on Feb. 28, 2017 for Singapore Application No. 11201504333Y, 6 pages.
New Zealand Examination Report for New Zealand Application No. 708463 dated Mar. 16, 2017, 3 pages.
Australian Search Report for Australian App. No. 20133358988 dated Apr. 11, 2017, 4 pages.
Office Action dated Apr. 7, 2017 for U.S. Appl. No. 14/063,252.

(56) References Cited

OTHER PUBLICATIONS

Chinese Office Action for Chinese Application No. 201380065127.5 dated Apr. 1, 2017, 14 pages.
Japanese Office Action for Japanese Application No. 2014-515882, dated Apr. 4, 2017, 6 pages.
New Zealand Examination Report for New Zealand Application No. 708552 dated Mar. 29, 2017, 2 pages.
Australian Search Report for Australian App. No. 2013359028, dated Apr. 10, 2017, 5 pages.
Chinse Office Action for Chinese Patent App. No. 201511030247.9 dated Apr. 5, 2017, 12 pages.
Office Action dated Feb. 24, 2017 for U.S. Appl. No. 14/188,504.
Office Action dated Feb. 28, 2017 for U.S. Appl. No. 15/004,263.
Office Action dated Mar. 6, 2017 for U.S. Appl. No. 14/108,142.
Chinese Office Action for Chinese App. No. 201480052411.3 dated Feb. 28, 2017, 16 pages.
New Zealand First Examination Report for New Zealand Application 708546 dated Feb. 23, 2014, 2 pages.
Supplemental European Search Report for European App. No. 14836418 dated Feb. 23, 2017, 6 pages.
Office Action for Chinese Patent Application No. 201380065116.7, dated Mar. 1, 2017, 9 pages.
Office Action dated Mar. 17, 2017 for U.S. Appl. No. 14/106,276.
Office Action dated Mar. 20, 2017 for U.S. Appl. No. 14/188,504.
Chinese Office Action dated Mar. 10, 2017 for Chinese Patent Application 201480007369.3, 11 pages.
Office Action dated Mar. 30, 2017 for U.S. Appl. No. 15/137,657.
Office Action dated Mar. 24, 2017 for U.S. Appl. No. 14/506,906.
Chinese Office Action for Chinese App. No. 201380065089.3 dated Apr. 21, 2017, 10 pages.
Applied Plastics Engineering Handbook, 1st edition, edited by Myer Kutz, published Jul. 20, 2011, 2 pages.
Chinese Office Action for Chinese App. No. 201380065781.6 dated May 10, 2017, 11 pages.
Office Action dated Jun. 7, 2017 for U.S. Appl. No. 15/388,319; (pp. 1-21).
Chinese Office Action for Chinese Application No. 201280051426.9 dated May 15, 2017, BP-356 CN, 12 pages.
Chinese Office Action for Chinese App. No. 201380041896.1 dated May 22, 2017, BP-386 CN, 9 pages.
Taiwan Office Action for Taiwan App. No. 101121655 received Jun. 14, 2017, BP-354 TW, 29 pages.
Australian Examiner's Report for Australian App. No. 2014244210 dated Jun. 16, 2017, BP-392 AU, 4 pages.
European Examination Report for European App. No. 13863308.6 dated May 17, 2017, BP-374 EP, 3 pages.
Extended European Search Report for European App. No. 14836418.5 dated Jun. 6, 2017, BP-428 EP, 14 pages.
Office Action dated Jun. 13, 2017 for U.S. Appl. No. 14/858,193; (pp. 1-21).
Japanese Office Action for Japanese Patent App. No. 2015-539838 dated Jun. 6, 2017, BP-395 JP, 19 pages.

* cited by examiner

BLANK FOR CONTAINER

PRIORITY CLAIM

This application claims priority under 35 U.S.C. §119(e) to U.S. Provisional Application Ser. No. 61/737,406, filed Dec. 14, 2012, which is expressly incorporated by reference herein.

BACKGROUND

The present disclosure relates to vessels, and in particular to insulated blanks for containers. More particularly, the present disclosure relates to a blank for an insulated container formed from polymeric materials.

SUMMARY

A vessel in accordance with the present disclosure is configured to hold a product in an interior region formed in the vessel. In illustrative embodiments, the vessel is an insulated container such as a drink cup, a tray, or a box.

In illustrative embodiments, a blank may be arranged to establish a container. The blank includes a base, a first side wall, a second side wall, a front wall, and a back wall. Together the base, the first side wall, the second side wall, the front wall, and the back wall cooperate to define an interior region therebetween. In illustrative embodiments, the blank is made from a sheet including an insulative cellular non-aromatic polymeric material.

In illustrative embodiments, the insulative cellular non-aromatic polymeric material included in the blank is configured in accordance with the present disclosure to provide means for enabling localized plastic deformation in at least one selected region of the body (e.g., the region interconnecting the base and the first side wall) to provide (1) a plastically deformed first material segment having a first density in a first portion of the selected region of the blank and (2) a second material segment having a relatively lower second density in an adjacent second portion of the selected region of the blank. In illustrative embodiments, the more dense first material segment is thinner than the second material segment.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

DETAILED DESCRIPTION

Figure 1:
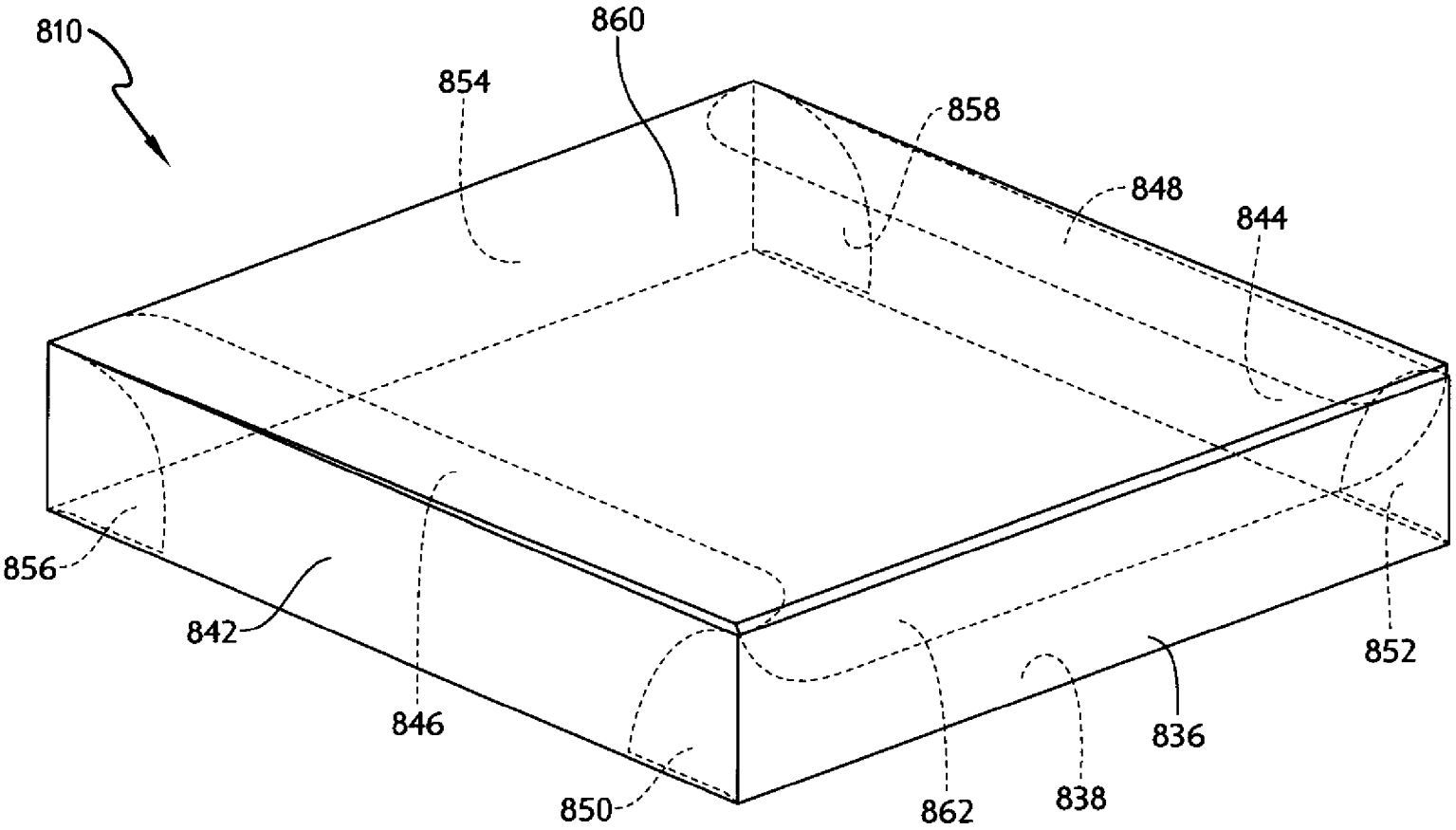
FIG. 1 is perspective view of an insulative container in accordance with the present disclosure made from a blank as suggested in FIGS. 2 and 3 and showing that the insulative container includes a floor, a cover spaced apart above the floor, a front wall, an opposite back wall, and two interconnecting side walls.
Figure 2:
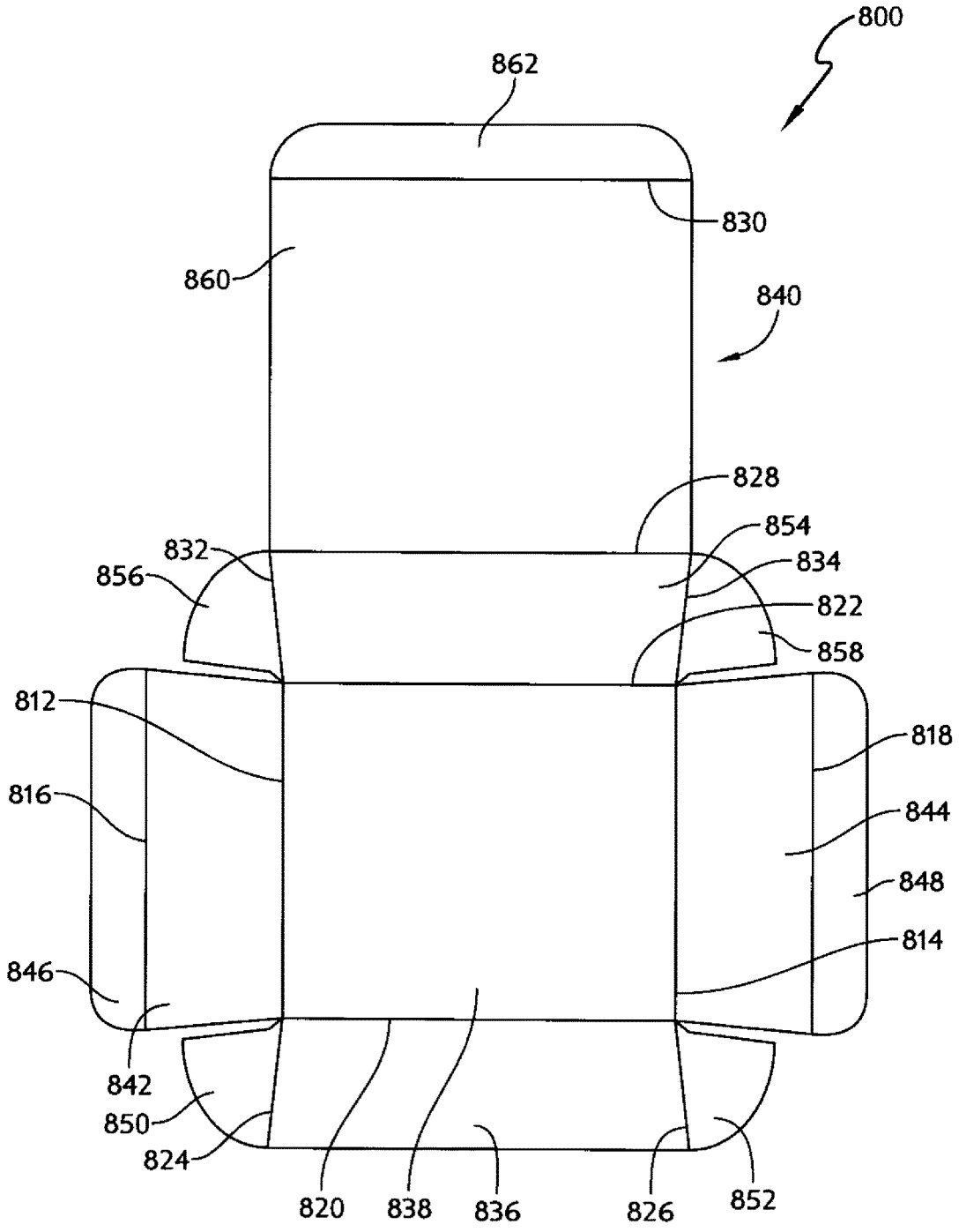
FIG. 2 is plan view of the blank used to form the insulative container of FIG. 1.
Figure 3:
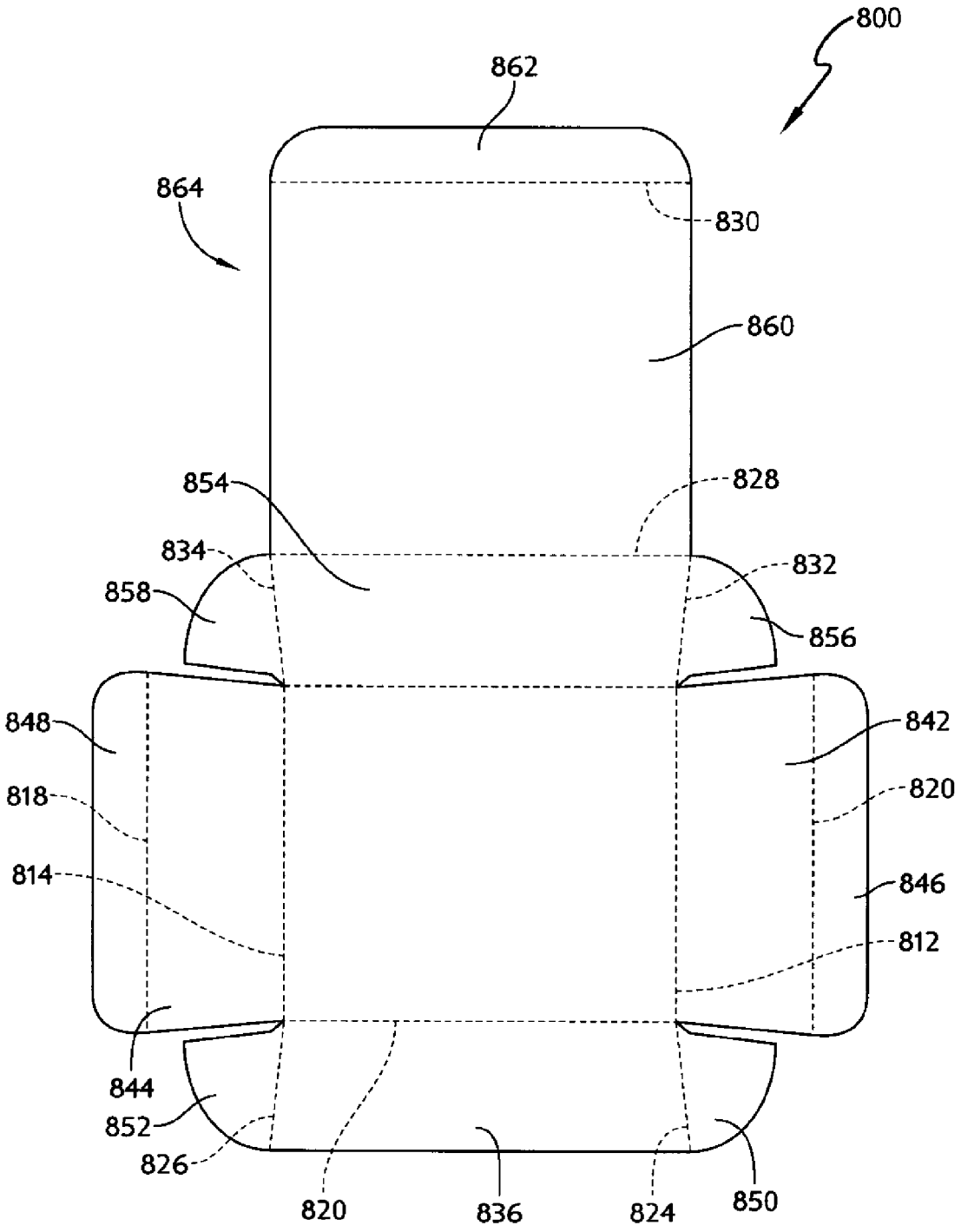
FIG. 3 is a plan view showing an opposite side of the blank of FIG. 1 and showing that the blank includes graphics which may be displayed on the insulative container after the blank is folded to form the insulative container as shown in FIG. 1.

Localized plastic deformation is provided in accordance with the present disclosure in, for example, a region 820 included in a blank 800 about which a front wall 836 is folded relative to a base 838 comprising an insulative cellular non-aromatic polymeric material as suggested in FIGS. 1-3. A material has been plastically deformed, for example, when it has changed shape to take on a permanent set in response to exposure to an external compression load and remains in that new shape after the load has been removed.

Blank 800 for container 810 is formed from a sheet including insulative cellular non-aromatic polymeric material as suggested in FIGS. 1-3. Container 810 is formed when blank 800 is folded and glued as shown in FIG. 1. Blank 800 includes regions 812, 814, 816, 818, 820, 822, 824, 826, 830, 832, 834 (also called connecting webs 812, 814, 816, 818, 820, 822, 824, 826, 830, 832, 834) of localized plastic deformation that correspond to fold lines.

Blank 800 includes a first side 840 that corresponds to the inner surfaces of container 810 as suggested in FIG. 2. Blank 800 may be formed in a blank forming process as described in U.S. patent application Ser. No. 13/526,444, incorporated herein by reference. Blank 800 is cut to include the perimeter shown in FIGS. 2 and 3 and a pressing operation may reduce the regions 812, 814, 816, 818, 820, 822, 824, 826, 830, 832, 834 to define base 838 (also called floor 838) and two side walls 842, 844 coupled to base 838. Two respective flaps 846 and 848 are coupled to side walls 842 and 844. A front wall 836 is coupled to base 838 with two flaps 850 and 852 coupled to front wall 836. A back wall 854 is coupled to base 838. Two flaps 856 and 858 are coupled to back wall 854 and are positioned to engage respective side walls 842 and 844 when blank 800 is folded to form container 810. A cover 860 is also coupled to back wall 854 and a flap 862 is coupled to cover 860 as shown in FIGS. 2 and 3.

When assembled, flaps 850 and 852 are secured to respective side walls 842 and 844; flaps 842 and 844 are each secured to cover 860; flap 862 is secured to front wall 836 and flaps 856 and 858 are secured to side walls 842, 844. Flaps 846, 848, 850, 852, 856, 858, and 862 are secured through gluing. In some embodiments, heat may be applied to flaps 846, 848, 850, 852, 856, 858, and 862 such that flaps 846, 848, 850, 852, 856, 858, and 862 are secured to walls 836, 842, 844 by a heat seal. In other embodiments, an adhesive may be applied to flaps 846, 848, 850, 852, 856, 858, and 862 such that flaps 846, 848, 850, 852, 856, 858, and 862 are secured to the walls 836, 842, 844 by the adhesive.

As shown in FIGS. 1 and 3, a second side 864 of blank 800 corresponds to an outer surface of container 810 when container 810 is assembled. Relief provided by regions 812, 814, 816, 818, 820, 822, 824, 826, 830, 832, and 834 minimizes creasing or buckling on the second side 864 when container 810 is assembled.

Blank 800 is formed from a sheet including insulative cellular non-aromatic polymeric material as disclosed herein. In accordance with the present disclosure, the insulative cellular non-aromatic polymeric material is configured (by application of pressure-with or without application of heat) to provide means for enabling localized plastic deformation in at least one selected region (for example, region 820) of blank 800 to provide a plastically deformed first material segment having a first density located in a first portion of the selected region of blank 800 and a second material segment (based 838) having a second density lower than the first density located in an adjacent second portion of the selected region blank 800 without fracturing the insulative cellular non-aromatic polymeric material so that a predetermined insulative characteristic is maintained in container 810.

Blank 800 is formed from a sheet including insulative cellular non-aromatic polymeric material and a skin coupled to one side of the insulative cellular non-aromatic polymeric material. In one embodiment of the present disclosure, text and artwork or both can be printed on a film included in the skin. The skin may further comprise an ink layer applied to the film to locate the ink layer between the film and the insulative cellular non-aromatic polymeric material. In another example, the skin and the ink layer are laminated to the insulative cellular non-aromatic polymeric material by an adhesive layer arranged to lie between the ink layer and the insulative cellular non-aromatic polymer material. As an example, the skin may be biaxially oriented polypropylene.

Insulative cellular non-aromatic polymeric material comprises, for example, a polypropylene based resin having a high melt strength, one or both of a polypropylene copolymer and homopolymer resin, and one or more cell-forming agents. As an example, cell-forming agents may include a primary nucleation agent, a secondary nucleation agent, and a blowing agent defined by gas means for expanding the resins and to reduce density. In one example, the gas means comprises carbon dioxide. In another example, the base resin comprises broadly distributed molecular weight polypropylene characterized by a distribution that is unimodal and not bimodal. Further details of a suitable material for use as insulative cellular non-aromatic polymeric material is disclosed in U.S. patent application Ser. No. 13/491,327, previously incorporated herein by reference.

Portions (850, 852, 836, 846, 842, 838, 844, 848, 856, 854, 858, 862, 860) of blank 800 have a generally uniform first thickness (also called nominal thickness) while regions (812, 814, 816, 818, 820, 822, 824, 826, 830, 832, 834) each have a second thickness. The second thickness, through plastic deformation, is about 50% of the generally uniform first thickness. In one illustrative example, front wall 836 is folded about connecting web 820 relative to base 838 during an illustrative container-forming process.

Blanks may be used to form other containers in accordance with the present disclosure. Disclosure of other containers formed using blanks may be found in U.S. patent application Ser. No. 13/491,007 and is incorporated by reference in its entirety herein. One suitable container-manufacturing process that makes blanks and containers is disclosed in U.S. patent application Ser. No. 13/526,444 and is incorporated by reference in its entirety herein. Another process for forming blanks is disclosed in U.S. patent application No. 61/737,222 which is incorporated by reference in its entirety.

The invention claimed is:

1. A blank for a container comprising a base including at least a first edge, a second edge spaced apart from the first edge, a third edge, and a fourth edge spaced apart from the third edge, a first side wall coupled to the base along the first edge, a second side wall coupled to the base along the second edge, a front wall coupled to the base along the third edge, and a back wall coupled to the base along the fourth edge, wherein the blank is made from a sheet of insulative cellular non-aromatic polymeric material, wherein the insulative cellular non-aromatic polymeric material includes a cell forming agent and a base resin having a high melt strength polypropylene, wherein each of the first side wall, the second side wall, the front wall, and the back wall all have a first thickness and the blank further comprises a flap at an outboard edge of the first side wall, the flap being separated from the first side wall by an area having a second thickness, and the second thickness being less than the first thickness, wherein each area having the second thickness is plastically deformed, and wherein the second wall thickness is plastically deformed without fracturing the insulative cellular non-aromatic polymeric material so that a predetermined insulative characteristic is maintained in the blank.

2. The blank of claim 1, wherein each of the first side wall, the second side wall, the front wall, and the back wall all have a first thickness and separated from the base by a respective region that has a second thickness that is less than the first thickness.

3. The blank of claim 2, further comprising first and second flaps positioned at side edges of the front wall, the first flap being separated from the front wall by an area having the second thickness, and the second flap being separated from the front wall by an area having the second thickness.

4. The blank of claim 2, further comprising a flap at an outboard edge of the first side wall, the flap being separated from the first side wall by an area having the second thickness.

5. The blank of claim 2, further comprising a flap at an outboard edge of the second side wall, the flap being separated from the first side wall by an area having the second thickness.

6. The blank of claim 2, further comprising first and second flaps positioned at side edges of the back wall, the first flap being separated from the back wall by an area having the second thickness, and the second flap being separated from the back wall by an area having the second thickness.

7. The blank of claim 2, wherein each of the first side wall, the second side wall, the front wall, and the back wall all have a first thickness and the blank further comprises a cover coupled to the back wall at an outboard edge of the cover, the cover separated from the back wall by an area having a second thickness, and the second thickness is less than the first thickness.

8. The blank of claim 1, wherein each of the first side wall, the second side wall, the front wall, and the back wall all have a first thickness and the blank further comprises first and second flaps positioned at side edges of the front wall, the first flap being separated from the front wall by an area having the second thickness and the second flap being separated from the front wall by an area having the second thickness.

9. The blank of claim 8, further comprising a flap at an outboard edge of the first side wall, the flap being separated from the first side wall by an area having the second thickness.

10. The blank of claim 8, further comprising a flap at an outboard edge of the second side wall, the flap being separated from the first side wall by an area having the second thickness.

11. The blank of claim 8, further comprising first and second flaps positioned at side edges of the back wall, the first flap being separated from the back wall by an area having the second thickness and the second flap being separated from the back wall by an area having the second thickness.

12. The blank of claim 8, further comprising a cover coupled to the back wall at an outboard edge of the cover, the cover separated from the back wall by an area having the second thickness.

13. The blank of claim 1, further comprising a flap at an outboard edge of the second side wall, the flap being separated from the first side wall by an area having the second thickness.

14. The blank of claim 1, further comprising first and second flaps positioned at side edges of the back wall, the first flap being separated from the back wall by an area the second thickness and the second flap being separated from the back wall by an area having the second thickness.

15. The blank of claim 1, further comprising a cover coupled to the back wall at an outboard edge of the cover, the cover having the first thickness, and the cover being separated from the back wall by an area having the second thickness.

16. The blank of claim 1, further comprising a cover coupled to the back wall at an outboard edge of the cover, the cover separated from the back wall by an area having the second thickness.

17. The blank of claim 16, wherein each area having the second thickness is reduced to about 50% of the generally uniform first thickness.

18. The blank of claim 17, wherein each area having the second thickness is deformed to take a permanent set.

19. The blank of claim 17, wherein each area having the second thickness comprises a localized area of higher density.

20. The blank of claim 17, wherein cells of the insulative cellular non-aromatic polymeric material remain unbroken in the areas having the second thickness.

21. The blank of claim 1, wherein the high melt strength polypropylene is a copolymer.

22. The blank of claim 21, wherein the base resin comprises broadly distributed molecular weight polypropylene.

23. The blank of claim 22, wherein the broadly distributed molecular weight polypropylene is characterized by a molecular weight distribution that is unimodal.

24. The blank of claim 1 wherein the cell-forming agent includes a blowing agent selected from a group consisting of: carbon dioxide, nitrogen, helium, argon, and mixtures thereof.

* * * * *